United States Patent [19]

Nishiyama

[11] Patent Number: 4,827,254

[45] Date of Patent: May 2, 1989

[54] DISPLAY APPARATUS ADAPTED TO DISPLAY VARIOUS TYPES OF MODIFIED CHARACTERS

[75] Inventor: Masaki Nishiyama, Tokyo, Japan

[73] Assignee: Canon Kabushiki Kaisha, Tokyo, Japan

[21] Appl. No.: 791,402

[22] Filed: Oct. 25, 1985

[30] Foreign Application Priority Data

Oct. 30, 1984 [JP] Japan ..... 59-226841
Oct. 31, 1984 [JP] Japan ..... 59-229776
Oct. 31, 1984 [JP] Japan ..... 59-229777

[51] Int. Cl.[4] ..... G09G 1/00

[52] U.S. Cl. ..... 340/790; 340/735; 340/748

[58] Field of Search ..... 340/790, 734, 735, 748, 340/721; 400/70, 76

[56] References Cited

U.S. PATENT DOCUMENTS 3,678,497 7/1972 Watson et al. ..... 340/735
3,996,584 12/1976 Plager ..... 340/790
4,186,393 1/1980 Leventer ..... 340/748
4,314,357 2/1982 Kimura et al. ..... 340/735
4,491,832 1/1985 Tanaka ..... 340/721
4,517,560 5/1985 Murayama et al. ..... 340/790
4,686,525 8/1987 Nagata ..... 340/735

*Primary Examiner*—Gerald L. Brigance
*Assistant Examiner*—Jeffery A. Brier
*Attorney, Agent, or Firm*—Fitzpatrick, Cella, Harper & Scinto

[57] ABSTRACT

A display apparatus for displaying a dot pattern comprises a memory in which a plurality of character patterns are stored, a second memory in which second character patterns different from predetermined character patterns among the character patterns stored in the memory are stored, and a display device which can display both the character pattern stored in the memory and the second character pattern stored in the second memory. The second character pattern may be a bold, underlined, superscript, or subscript character pattern. When a desired character is displayed as a bold character, for example, the bold character is formed either by reading out the bold character from the second memory in which the bold character has preliminarily been stored or by changing the desired character to the bold character by a character pattern changing circuit.

10 Claims, 13 Drawing Sheets

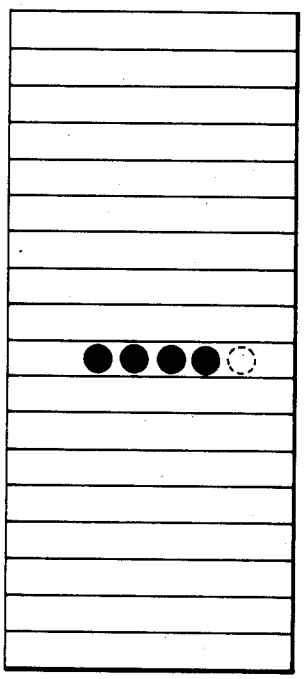
FIG. 2
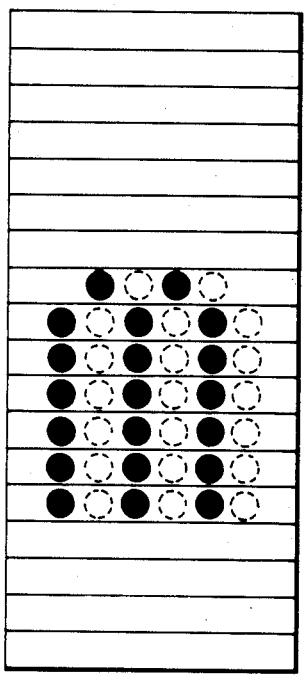
FIG. 3
| | | | | | | | |
|---|---|---|---|---|---|---|---|
| 23H | 2BH | 2DH | 2EH | 3AH | 3BH | 4DH | 54H |
| 57H | 5AH | 5CH | 5FH | 6DH | 77H | 7AH | FFH |
FIG. 4

FIG. 14A
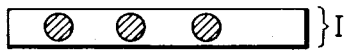
0 1 1 1 0 1 0 0 ; ALb
FIG. 14B
0 0 1 0 1 0 1 0 0 ; ONE BIT RIGHT SHIFT
FIG. 14C
0 0 0 0 1 0 1 0 1 ; THREE BITS RIGHT SHIFT
FIG. 14D
0 0 0 0 0 0 0 0 1 0 0 0 0 0 0 0 ; BXb 0080H
FIG. 14E
0 → 0 0 0 0 0 0 1 0 0 0 0 0 0 0 0 0 ; TWO BITS LEFT SHIFT
FIG. 14F
0 0 0 0 0 0 1 0 ; BHb
FIG. 14G
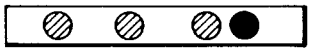
; LOGICAL ADDITION OF ALb AND BHb
0 1 0 1 0 1 1 0

DISPLAY APPARATUS ADAPTED TO DISPLAY VARIOUS TYPES OF MODIFIED CHARACTERS

BACKGROUND OF THE INVENTION

1. Field of the Invention

The present invention relates to a display apparatus which outputs a pattern of the dot expression system and, more particularly, to a display apparatus which is constituted such as to send various pattern information in accordance with the attribute of the designated pattern.

2. Description of the Prior Art

Hitherto, a number of apparatuses which output pattern information of, for example, the dot expression format to form a desired pattern have been known. Such pattern information output apparatuses have an advantage such that when a number of kinds of patterns are formed as well, its output pattern can be easily changed. A CRT display apparatus of the dot refresh type, a wire-dot printer, a thermal printer, and the like are known as the pattern output apparatuses of the dot expression format.

In the above-mentioned CRT display apparatus of the dot refresh type, a code is predetermined for every pattern of a particular character or symbol, the pattern information (hereinafter, referred to as a font) of the particular character or symbol is read out in accordance with the code, the font read out is temporarily stored in a video RAM, such pattern information is repeatedly read out at a high speed, and thereby displaying it on the CRT display.

In the case where an underline is added to a character or a character is displayed as a thick character (hereinafter, referred to as a bold character), to emphasize the character by use of the foregoing CRT display apparatus of the dot refresh type, printer or the like, in order to avoid an increase in capacity of a memory for storing the fonts, the underlined fonts and bold fonts are not individually stored, but the pattern information read out from the memory is subjected to a predetermined image process, thereby adding a desired underline to the pattern information or changing it to a bold character (patterns processed by said predetermined image process are hereinafter called "ornamented patterns"). In addition, in the case of inverting the contrast of a character as well, a predetermined image process is likewise performed. The above-mentioned underline, bold, inverting display, etc. are generally called "attribute" of a character.

As an example, a conventional technology in the case of displaying the "bold" character as one of the attributes of a character will now be described. In this case, the font read out from the memory is shifted to the left or right by only one dot, OR of the font derived and the font before shifting is obtained, the result of the arithmetic logic operation is transferred to the video RAM, and thereby realizing the bold display as a bold character.

However, the pattern information output apparatuses based on the above-mentioned systems have the following drawbacks.

(1) As shown in FIG. 2, in the case of bold displaying the minus symbol ("—") or the like, the font is merely laterally shifted by one dot, so that it is difficult to discriminate whether such a symbol is displayed as a bold character or not.

(2) In the case of bold displaying a small letter "m" (or "w" or the like) using a display device with a low resolution, as shown in FIG. 3, the dots are displayed at the adjacent positions, so that the letter itself will not be able to be discriminated.

Further, in a sentence processing apparatus using such a display apparatus, there are the cases of displaying special functions such as superscript (a character written immediately above or above and to the right or left of another character), subscript (a character written immediately below or below and to the right or left of another character), stop position (temporary print interruption point to exchange a daisy wheel (part for printing) or the like during the printing), change start position of a line space, and the like. For example, in the case of superscript, hitherto, an upward arrow (↑) is overlapped on a character and both the arrow and the character are together displayed. However, there are drawbacks such that it is very difficult for the operator to see such overlapped character and also it is impossible to discriminate the original character of the overlapped character. In addition, there is a risk such that such overlapped character reduces the use efficiency of a document processing apparatus.

SUMMARY OF THE INVENTION

It is an object of the present invention to provide a display apparatus equipped with memory means in which a plurality of character patterns are stored and second memory means in which different character patterns are stored with respect to predetermined character patterns, wherein a character which cannot be discriminated in the case where, for example, it is displayed as a bold character can be properly displayed.

Another object of the invention is to provide a bold character pattern generating apparatus in which, when a certain character is changed to a bold character, it is possible to determine whether the bold character is derived from memory means in which the bold patterns themselves are stored or by changing the character pattern.

Still another object of the invention is to provide a display apparatus in which when a pattern of a certain character pattern is changed, a change amount of the character pattern itself is made small, thereby preventing that discrimination of the displayed character becomes impossible.

Still another object of the invention is to provide a display apparatus in which when a certain character pattern and a decorative pattern are overlapped and displayed, they can be displayed as patterns which are easy to see.

BRIEF DESCRIPTION OF THE DRAWINGS

FIGS. 2 and 3 are dot arrangement diagrams for explaining drawbacks of the image process by way of a conventional technology;

FIG. 4 is a diagram showing a special table which is used in the embodiment;

FIGS. 14A to 14G are diagrams for explaining bold display for data of one line of a display pattern;

DETAILED DESCRIPTION OF PREFERRED EMBODIMENTS

The present invention will be described in detail hereinbelow with respect to an embodiment.

Figure 1:
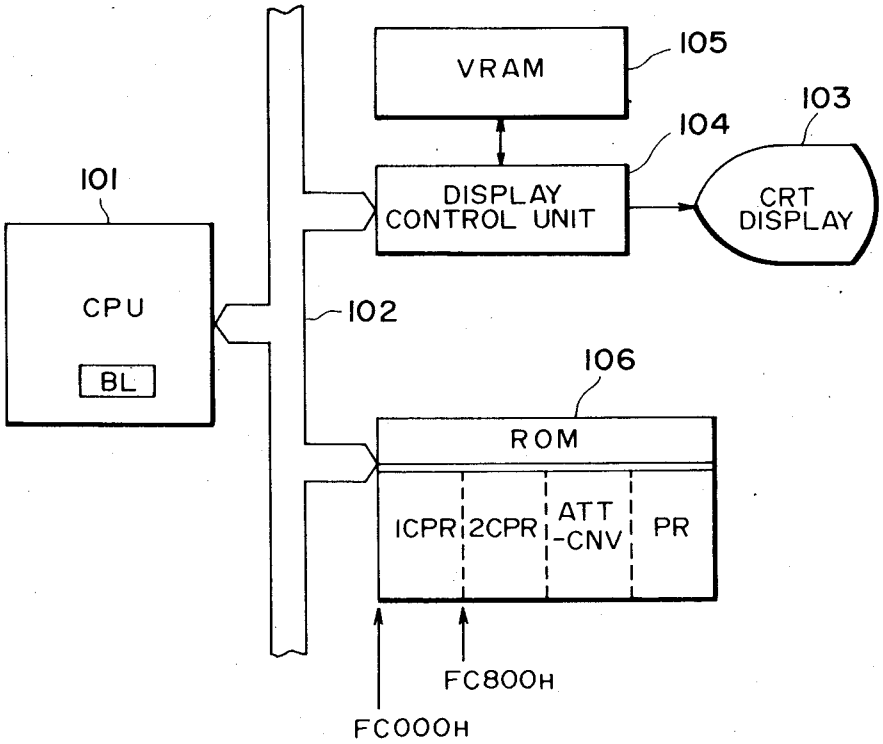
FIG. 1 is a schematic block diagram showing a whole arrangement of an embodiment of the present invention.

FIG. 1 shows a schematic arrangement of a pattern information output apparatus to which the present invention is applied. This apparatus includes a CRT display of the dot refresh type as will be explained in detail hereinafter.

Figure 5:
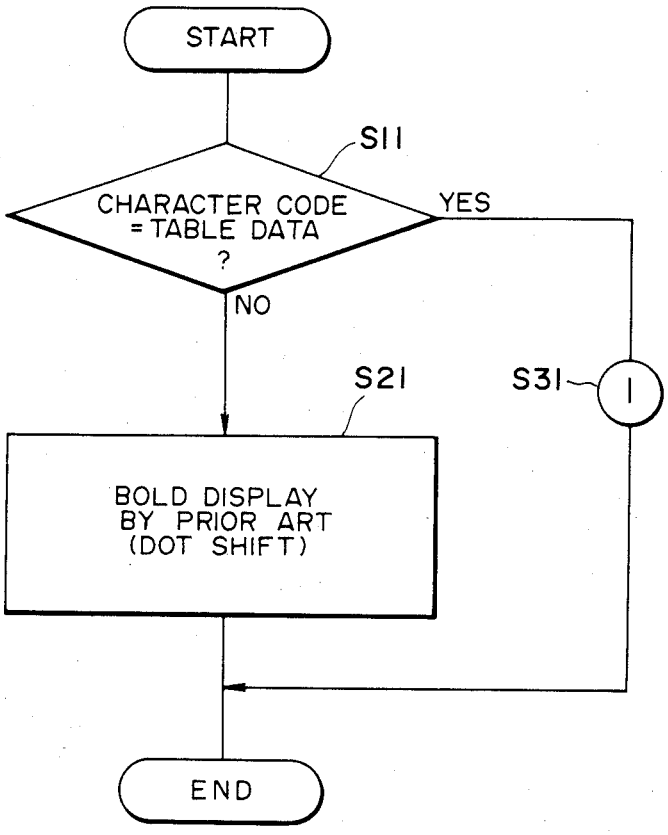
FIGS. 5 and 6 are flowcharts for explaining the control procedure of the embodiment.
Figure 6:
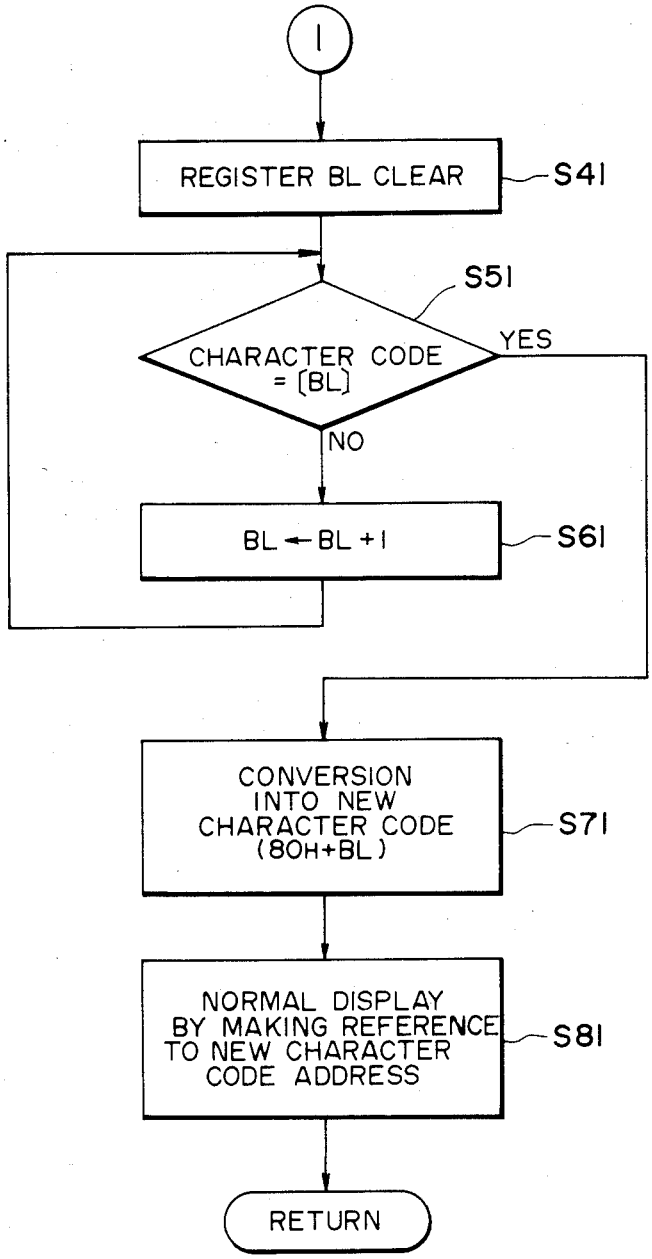

In FIG. 1, a CPU (central processing unit) 101 controls the operation of this apparatus in accordance with a predetermined control procedure (which will be explained later with reference to FIGS. 5 and 6) and has a register BL which will be explained later. A common bus 102 is connected to the CPU 101 A CRT display 103 displays a pattern on the basis of the raster scanning display system. A display control unit 104 sends pattern information of the CRT dot refresh type to the display 103. A video RAM (random access memory) 105 stores display dot patterns as much as one screen of the CRT and enables display dot patterns to be repeatedly read out at a high speed. A ROM (read only memory) 106 has: a memory area PR in which a sequence to be executed by the CPU 1 (for example, procedures as shown in FIGS. 5 and 6) is stored; an area 1CPR in which ordinary character fonts (first character patterns) are stored; an area 2CPR in which fonts of the bold types of predetermined characters (second character patterns) are stored; and an area in which an attribute conversion table ATT-CNV, which will be explained later, is stored.

FIG. 4 shows the "attribute conversion table" (hereinafter, referred to as the ATT-CNV table) which is used in this embodiment. The contents of the ATT-CNV table are stored in the ROM 6 shown in FIG. 1. With respect to the characters which will cause various problems in the case where they are bold displayed using a conventional dot shift technology (refer to FIGS. 2 and 3), the data shown in the ATT-CNV table represents the character codes of those characters. These character codes are the codes of which the ASCII codes were expressed as the hexadecimal numbers ("H" written at the right lower position of each code shown in the ATT-CNV table denotes the hexadecimal expression). A reference character FFH written at the last position of the ATT-CNV table is the data to indicate the end of table.

The character codes until "$7F_H$" for use in this embodiment are made coincident with the ASCII codes. The character codes of and subsequent to "$80_H$" are used as the new character codes which are peculiar to the embodiment. That is, in the ATT-CNV table shown in FIG. 4, the new character code "$80_H$" is assigned to the ASCII code "$23_H$" (indicative of "#") shown at the first position;

the new character code "$81_H$" is assigned to the ASCII code "$2B_H$" (indicative of "−") shown at the second position; and in a manner similar to the above, the new character code "$8C_H$" is assigned to the ASCII code "$6D_H$" (indicative of "m") shown at the thirteen position.

In the embodiment, as the addresses of the character codes, the ordinary character fonts have preliminarily sequentially been stored in the ROM 6 (refer to FIG. 1) from the address $FC000_H$ for every sixteen bytes (corresponding to one character). Therefore, the font for bold display of "$23_H$" (indicative of "#") shown at the first position of the ATT-CNV table corresponds to the new character code "$80_H$", so that it is constituted by sixteen bytes starting from the address $$FC000_H+80_H*10_H$$

in the ROM 6.

On one hand, the font for bold display of "$2B_H$" (indicative of "−") shown at the second position of the ATT-CNV table corresponds to the new character code "$81_H$", so that it is constituted by sixteen bytes starting from the address $$FC000_H+81_H*10_H$$

in the ROM 6.

In a manner similar to the above, the font for bold display of "$6D_H$" (indicative of "m") shown at the thirteen position of the ATT-CNV table corresponds to the new character code "$8C_H$", so that it is constituted by sixteen bytes starting from the address $$FC000_H+8C_H*10_H$$

in the ROM 6.

For the ordinary letter "m" which is not bold displayed, its ASCII code is "$6D_H$", so that it is constituted by sixteen bytes starting from the address $$FC000_H+6D_H*10_H$$

in the ROM 6.

FIGS. 5 and 6 show control flowcharts to perform the bold display by use of the embodiment.

The operation of the embodiment will then be described hereinbelow with reference to the ATT-CNV table shown in FIG. 4.

First, the procedure to display the bold of alphabet "A" will be explained.

A check is made to see if the ASCII code "$41_H$" of alphabet "A" is stored in the ATT-CNV table or not (step S11).

Since the code of "$41_H$" is not stored in the ATT-CNV table, the font of "A" is read out from the ROM 106 using the foregoing conventional technology (dot shift method shown in FIGS. 2 and 3), the patterns (refer to FIGS. 2 and 3) are written in the video RAM 105, and thereby displaying the bold of alphabet "A" on the CRT (step S21).

Next, the case of displaying a small letter "m" of alphabet will be described.

In this case, since the ASCII code "$6D_H$" indicative of alphabet "m" is stored in the ATT-CNV table (step S1), the processing routine jumps to the subroutine 1 shown in FIG. 6 (step S31).

Namely, when alphabet "m" is bold displayed using the conventional technology, the clear character cannot be obtained. Therefore, the following processes are performed.

The register BL in the CPU 101 is used as a pointer to indicate the position of each data in the ATT-CNV table. First, the register BL is cleared (step S41) and the first storage data "$23_H$" is indicated.

The content of the register BL is increased until the character code specified by the register BL and the character code "$6D_H$" of "m" coincide (steps S51, S61).

In the case where the character code of the character "m" to be bold displayed is found out in the ATT-CNV table ($BL=OC_H$), the new character code ($80_H+BL=80_H+OC_H=8C_H$) is set as already explained above. In other words, the conventional ASCII code is converted to the new character code as the code for bold display of alphabet "m" (step S71).

Figure 7:
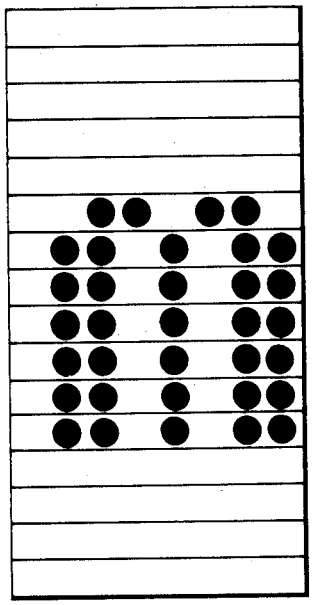
FIG. 7 is a dot arrangement diagram showing an example of bold display in the embodiment.

The font for bold display (for example, this font has a dot arrangement as shown in FIG. 7) is read out from the address ($FC000_H+8C_H$ $*10_H=FC8CO_H$) in the ROM corresponding to the character code ($8C_H$) newly set and is transferred to the VRAM 105, thereby displaying on the CRT in a normal manner (step S81). Therefore, in this case, the process for bold such as the lateral shift of dots or the like which has been conventionally known is not carried out.

In the foregoing embodiment, only the case where a dot display character is bold displayed was described. However, it is obvious that the present invention can be also applied to the case where an underline is added, where an inversion display is executed, or further where an ordinary image pattern is formed.

Figure 8:
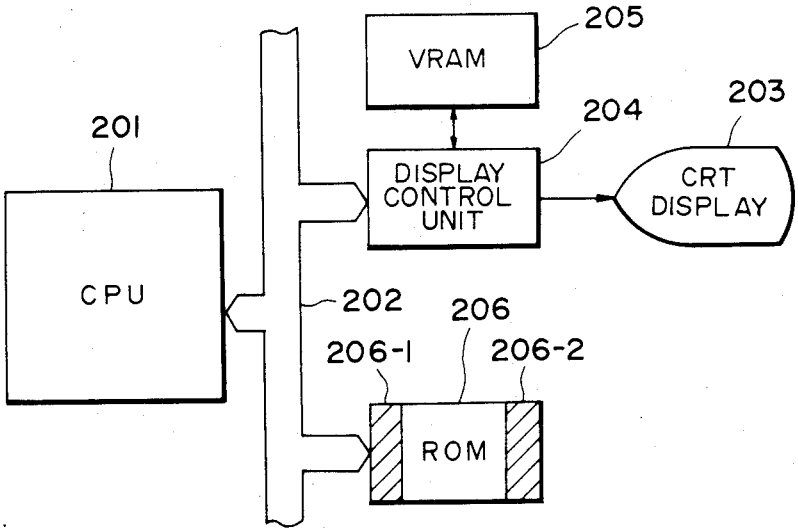
FIG. 8 is a control block diagram of a display apparatus of the second embodiment.

The second embodiment:

The second embodiment of the present invention will now be described in detail hereinbelow with reference to the drawings. FIG. 8 is a block diagram showing a principal functional constitution of a dot refresh type CRT display apparatus (hereinafter, referred to as a display apparatus) of the second embodiment according to the invention. It is needless to say that this display apparatus can be connected to any electronic equipment such as an electronic typewriter, work station or the like. In FIG. 8, a CPU (central processing unit) 201 executes the main control of the display apparatus in accordance with a predetermined procedure. The CPU 201 discriminates whether the pattern to be displayed in a CRT display 203 is, for example, an emphasis character or not and outputs the result of the discrimination to a display control unit 204, which will be mentioned later. Reference numeral 202 denotes a common bus of the CPU 201; 203 is the CRT display of the raster scanning display system; and 204 is the display control unit which discriminates the data from the CPU 201 and outputs proper pattern information of the dot refresh system such as a bold character, ordinary character, or the like to the CRT display 203. The CPU 201 discriminates the attribute of the input data (namely, the kind of pattern or whether it is the emphasis character or not, or the like) and transmits the data to the display control unit 204. The unit 204 may merely control the CRT display 203 in dependence on the data or may be the intelligent display control unit 204 which can be considered to be the constitution such that further another CPU is provided for the display side of the display control unit. In the case of such an intelligent unit, the data from the CPU 201 is recognized and discriminated and the display 203 may be controlled on the basis of the result of the discrimination. Therefore, the means for discriminating the attribute of a pattern may be equipped with the side of either the CPU or the display control means. A reference numeral 205 denotes a video RAM in which display dot patterns of one screen of the CRT can be stored and from which they can be repeatedly read out at a high speed, and 206 indicates a ROM in which the control procedure for the apparatus of the invention is stored (in an area 206-2) and font information is stored (in an area 206-1).

Figure 9A:
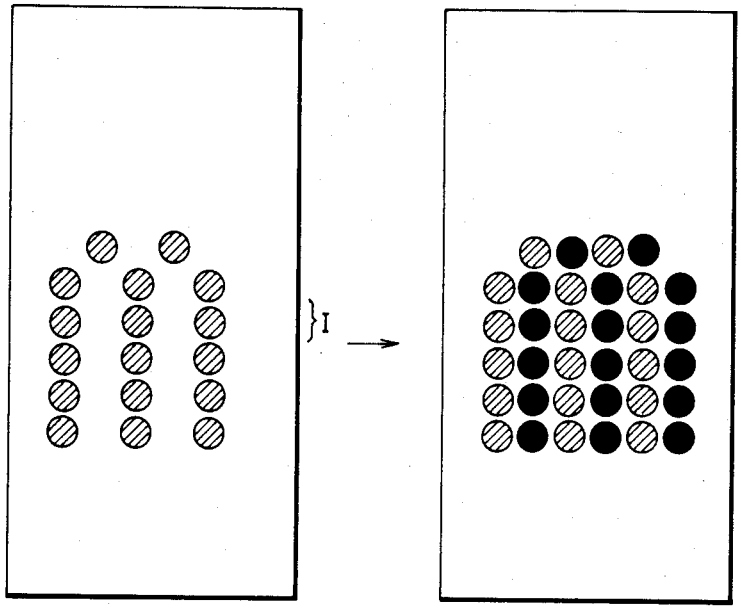
FIGS. 9A and 9B are diagrams for explaining conventional bold displays of letters "m" and "w"

Numerals to which "$_H$" is attached denote hexadecimal numbers hereinbelow. Although the code system conforms with ASCII in this embodiment, the font information has preliminarily sequentially been stored in the ROM 206 for every sixteen bytes as much as one character in accordance with the sequence of the codes from the address $FC000_H$. For example, the font of a small letter "m" as shown in FIG. 9A has the code "$6D_H$". Data of sixteen bytes is needed to display this small letter "m", so that the values $000_H$, $000_H$, $000_H$, $000_H$, $000_H$, $000_H$, $028_H$, $094_H$, $054_H$, $054_H$, $054_H$, $054_H$, $000_H$, $000_H$, $000_H$, $000_H$, $000_H$ are written as sixteen bytes starting from the address $$FC000_{H+6DH} *16=FC6D0_H$$

(in FIG. 9A, sixteen lateral rows are expressed by binary values in which the hatched circle is "1" and the other is "0").

Figure 10:
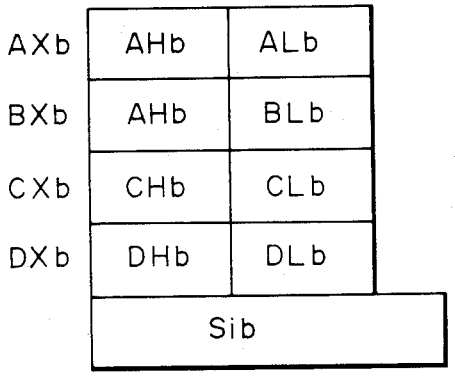
FIG. 10 is a diagram showing an arrangement of an internal register of a CPU 201.

FIG. 10 shows a constitution of the internal register of the CPU 201. A reference character AXb denotes a 16-bit register constituted by a register AHb indicative of high order eight bits and a register ALb representative of low order eight bits. Registers BXb, CXb and DXb are also similarly constituted. A 20-bit register Sib (the number of bits is not limited to twenty but may be sixteen bits or the like) is used as an address pointer. Those registers will be explained later. The procedure to bold display a small letter "m" with such a constitution as mentioned above will then be described.

Figure 11:
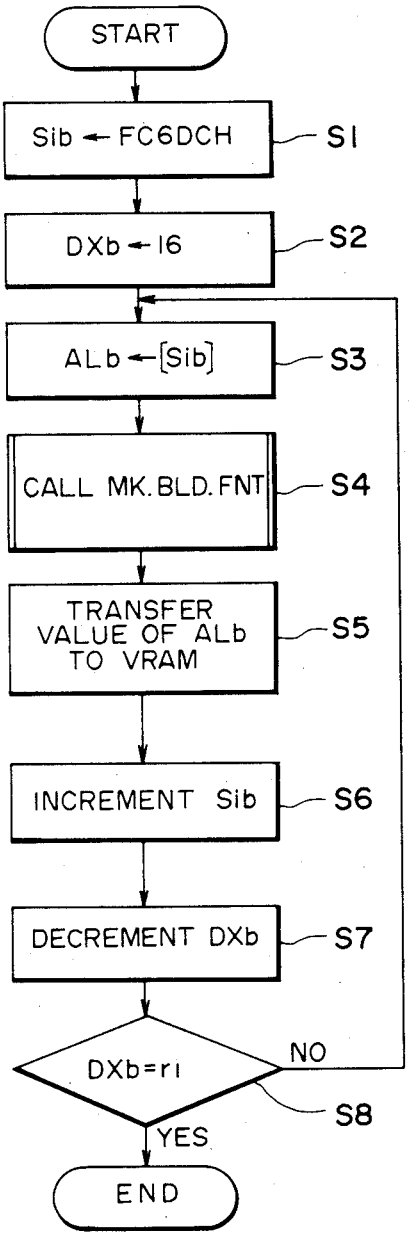
FIG. 11 is a control flowchart for bold display.
Figure 12:
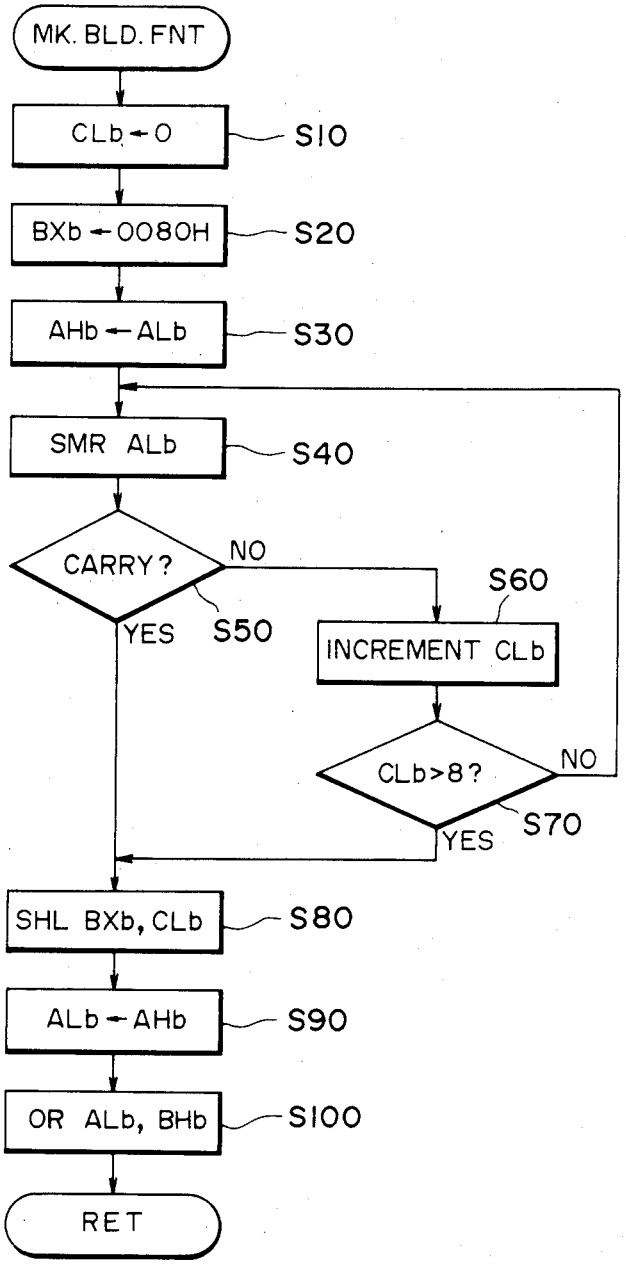
FIG. 12 is a further detailed control flowchart for bold display.

FIGS. 11 and 12 are control flowcharts for bold display in the case of a small letter "m". First, in step S1 in FIG. 11, the font information start address ($FCSD0_H$) of a small letter "m" is stored in the register Sib for the address pointer as mentioned above. In the next step S2, "16" representing the number of bytes constituting the font of one character is input to the register DXb shown in FIG. 10. Then, the content of the address specified by the register Sib is input to the register ALb in step S3.

The font for bold display of (CALL MK-BLD-FNT) is produced in the next step S4 (this step will be described in detail hereinafter). Then, in step S5, the value of the register ALb produced in step S4 is transferred to the VRAM 205. The value of the register Sib is increased by only "1" so as to instruct the next data in step S6. Further, the value of the register DXb is decreased by only "1" in step S7. A check is made to see if the content of the register DXb becomes "0" or not in step S8, thereby discriminating whether all data (as many as sixteen rows) of one character have been processed or not. If all data of one character have completely been processed (YES in step S8), the character is bold displayed.

Figure 9B:
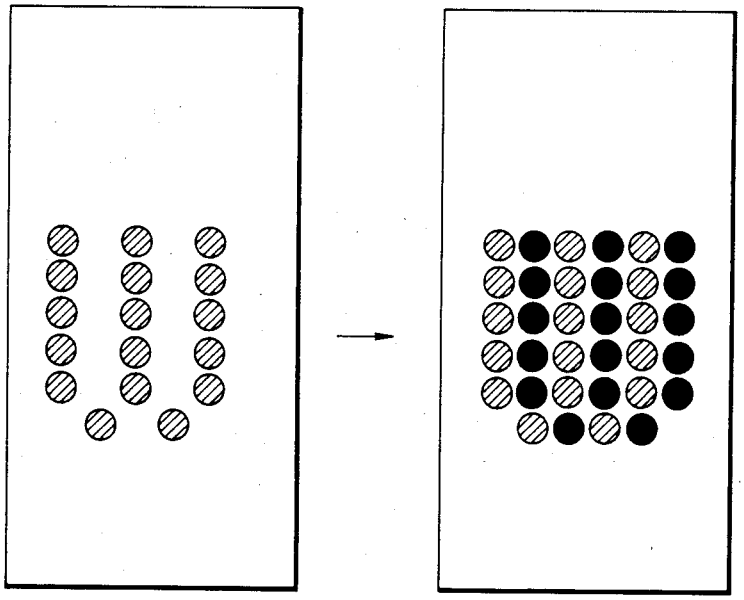

Then, FIG. 12 shows the control flowchart for explaining further in detail the process in step S4 shown in FIG. 11. First, in step S10, the register CLb serving as a counter of eight bits (one byte) in the lateral direction in FIGS. 9A and 9B is cleared. In the next step S20, the initial value $0080_H$ (this value will be explained later) is stored in the register BXb shown in FIG. 10 (in this case, this initial value consists of sixteen bits since BXb=BHb+BLb). In step S30, the value of the register ALb shown in FIG. 10 is copied to the register AHb using the data derived in step S3 in FIG. 11 to save.

Figure 13:
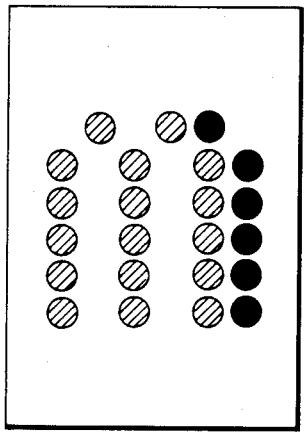
FIG. 13 is a diagram showing an example of bold display to which the present invention is applied.

In the subsequent steps S40 to S70, the rightmost bits of the font are detected and only these bits are shifted to the right in step S80. In steps S90 and S100, OR of the new data and the original data is obtained, so that the data for bold display (in the case of a letter "m", as shown in FIG. 13, the data in which only the rightmost bits of the font are thick, namely, to which the portions of black dots were added) is derived.

The case of FIG. 9A will be practically described. The register DXb indicates the case where the value of the DXb which is subtracted in step S7 in FIG. 11 is, for example, "8", namely, the row of the symbol "I" on the ninth row from the top. As shown in FIG. 14A, when the row of the symbol "I" is expressed by the binary value, it becomes "01010100".

First, in step S40 in FIG. 12, the value of the register ALb is shifted to the right by one bit (SHR) as shown in FIG. 14B. Next, a check is made to see if the carry generated, namely, the shifted data of the register ALb (the least significant bit of the register ALb immediately before shifting) is "0" or "1" in step S50. In the case of this embodiment, it is "0" in step S50, so that step S6 in FIG. 11 follows and the content of the CLb is increased by "1". Then, a check is made to see if the value of the register CLb is larger than "8" or not in step S70. In the case where the number of bits stored in the register CLb does not reach eight bits in the lateral direction of the character data (if NO in step S70), the processing routine is returned to step S40. In the case where the carry "1" is not included in all eight bits in the lateral direction, it is YES in step S50, so that step S80 follows. In the case of the embodiment, as will be obvious from FIGS. 14B and 14C, the carry becomes "1" when three bits of the row "I" are shifted (CL=2). At this time, it is YES in step S50 and step S80 is then executed. As described in conjunction with FIG. 10, ($0080_H$) of the register BXb is the data of sixteen bits (since BXb=BHb+BLb) as shown in FIG. 14D. In step S80, this data is shifted to the left by the value of the register CLb (=2 as mentioned above) on one-bit unit basis (FIG. 14E). Then, the content of the register AHb is stored in the register ALb in step S90 and the original data stored in step S3 in FIG. 11 is accessed. Namely, data "01010100" shown in FIG. 14A is accessed. In step S100 in FIG. 12, OR of the ALb=01010100 (FIG. 14A) and the BHb (the high order eight bits of the BXb after the shifting operation by two bits)=00000010 (FIG. 14F) is got, so that data "01010110" (FIG. 14G) is derived. That is, the data for bold display with regard to the row indicated at the symbol I becomes as shown in FIG. 14G and this value is stored in the register ALb. Subsequently, the processing routine is returned to the main program shown in FIG. 11 and the data shown in FIG. 14G is transferred to the VRAM 205 in step S5. The description in and subsequent step S5 of the main program is similar to the above. By executing the above-explained procedure with respect to all rows (sixteen rows) to bold display one character, the bold character is displayed as shown in FIG. 13 (the marks • denote the dots which are written to perform the bold display); therefore, the detailed description is omitted.

Figure 15:
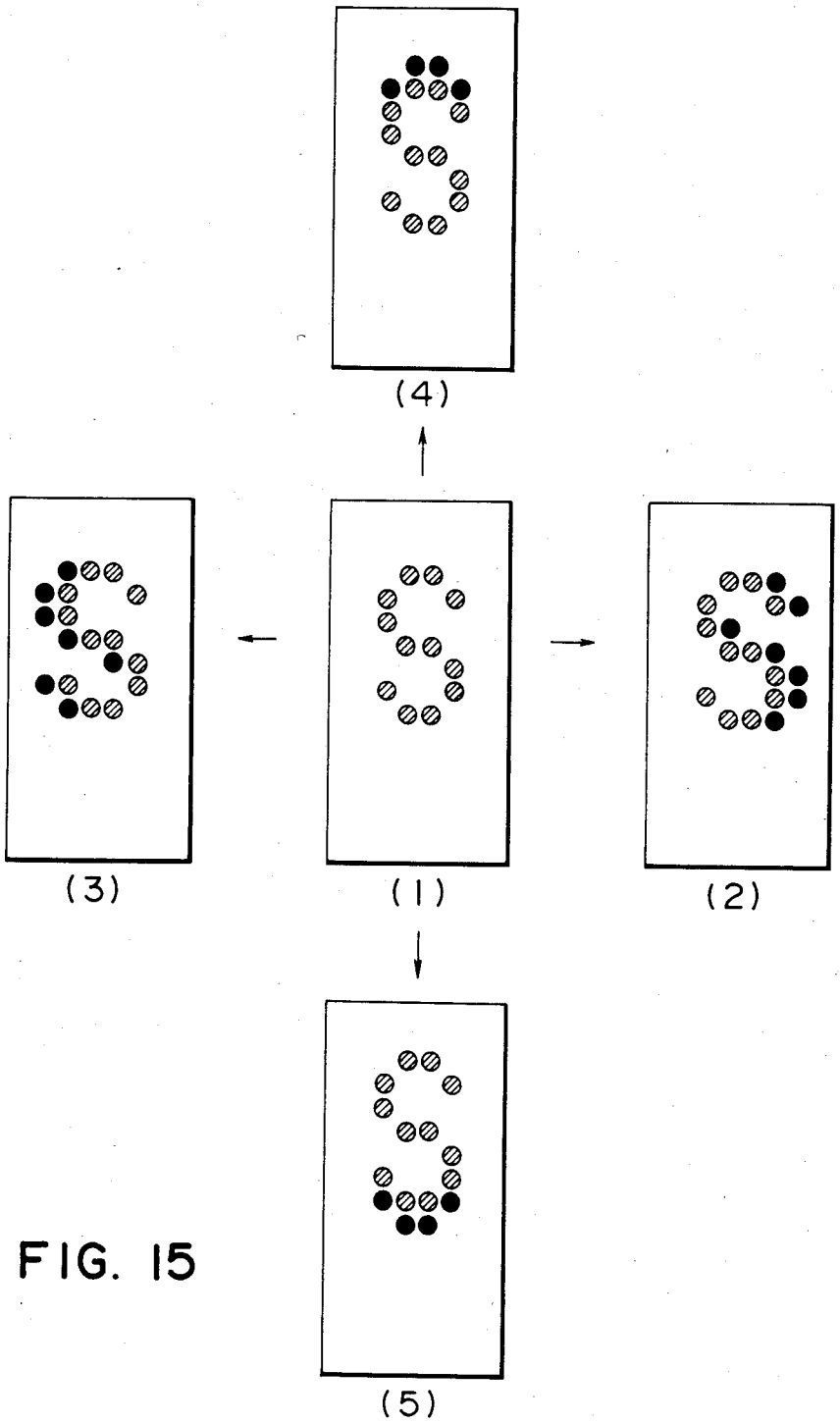
FIG. 15 is an explanatory diagram showing various kinds of bold displays for a character "S"

Similarly, in the case of a letter S shown in FIG. 15(1), the bold character (the marks • denote the dots which are written for emphasis) as shown in FIG. 15(2) is displayed. Although only the rightmost bit of the display pattern was made thick in the embodiments, the present invention is not limited to this. It will be understood from the concept of the invention that it is obviously possible to make, in particular, the leftmost bit, upper bits, or lower bits of a display pattern thick (refer to FIGS. 15(3), 15(4), 15(5)); further, a combination thereof may be adopted.

The above-described procedure is effective to all characters. However, depending on the form, their bold characters may be displayed by a conventional method and it is also possible to constitute the display system which can be easily discriminated with a further simple constitution by way of a combination of the method according to the present invention and a conventional method.

As described in detail in the above, according to the present invention, it is possible to provide a display apparatus which can emphasize a portion of a character with an extremely simple constitution and thereby making it possible to display a character which can be fairly easily discriminated.

In addition, according to the invention, it is possible to constitute the display system which displays a bold character by way of a pattern which can be easily discriminated.

Figure 16:
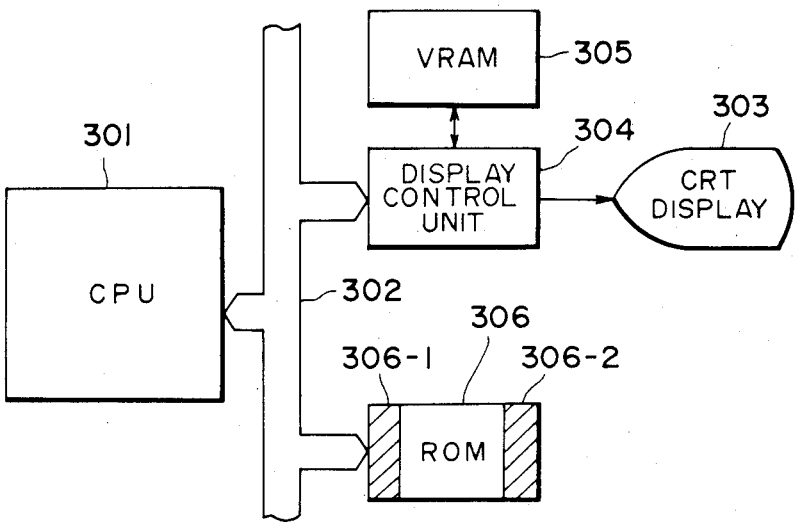
FIG. 16 is a control block diagram of a display apparatus of the third embodiment.

Third embodiment:

The third embodiment of the present invention will then be described in detail hereinbelow with reference to the drawings. FIG. 16 is a block diagram showing a principal functional constitution of a dot refresh type CRT display apparatus (hereinafter, referred to as a display apparatus) of the third embodiment according to the invention.

In FIG. 16, a CPU (central processing unit) 301 executes the main control of the display apparatus in accordance with a predetermined procedure. A reference numeral 302 denotes a common bus of the CPU 301; 303 is a CRT display of the raster scanning display system; 304 a display control unit which outputs pattern information of the dot refresh system to the CRT display 303; 305 a video RAM in which display dot patterns of one screen of the CRT can be stored and from which they can be repeatedly read out at a high speed; and 306 a ROM in which a control procedure for the apparatus of the invention is stored (in an area 306-2) and font information is stored (in an area 306-1). In the display apparatus, means for discriminating whether the pattern to be displayed is the pattern with a special function or not may be the CPU 301 or display control unit 304.

Figure 17:
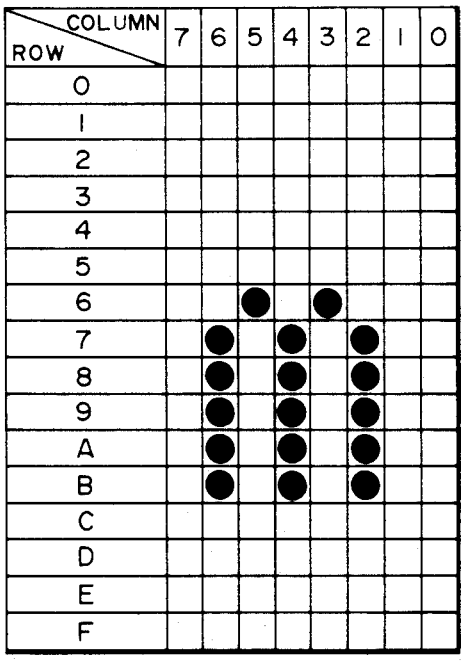
FIG. 17 is a diagram showing an example of display.

Numerals to which "H" is attached denote hexadecimal numbers. Although the code system conforms with ASCII in this embodiment, the font information has preliminarily sequentially been stored in the ROM 306 for every sixteen bytes as much as one character in accordance with the sequence of the codes from the address $FC000_H$ in the ROM. For example, the font of a small letter "m" displayed as shown in FIG. 17 has the code of $6D_H$. However, the data of sixteen bytes is needed to display "m", so that the values $000_H$, $000_H$, $000_H$, $000_H$, $000_H$, $000_H$, $028_H$, $094_H$, $054_H$, $054_H$, $054_H$, $054_H$, $000_H$, $000_H$ $000_H$, $000_H$ are stored as sixteen bytes starting from the address $$FC000_H + 6D_H * 16 = FC6D0_H$$

(the binary values in which the black dots denote "1" and the others represent "0" in FIG. 17).

For example, in FIG. 17, two black dots exist in the sixth row. When the columns are divided into the portion from the fourth to seventh columns and the portion from the zeroth to seventh columns and the black dots are set to "1", these two portions can be respectively expressed by "0010" and "1000" and become $028_H$ (hexadecimal number). Similarly, in the case of the row B, those two portions can be expressed by "0101" and "0100" and become $054_H$ (hexadecimal number).

Figure 18:
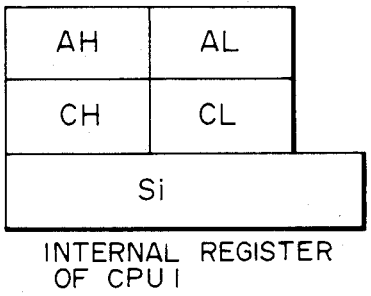
FIG. 18 is a diagram for explaining an internal register of a CPU 301.

Next, FIG. 18 is a diagram for explaining the internal register of the CPU 301 in FIG. 16. Reference characters AL, AH, CL, and CH are 8-bit registers, and Si is a 20-bit register (the number of bits is not limited to twenty but may be sixteen bits or the like) which is used as an address pointer. These registers will be described in detail hereinafter.

Figure 19D:
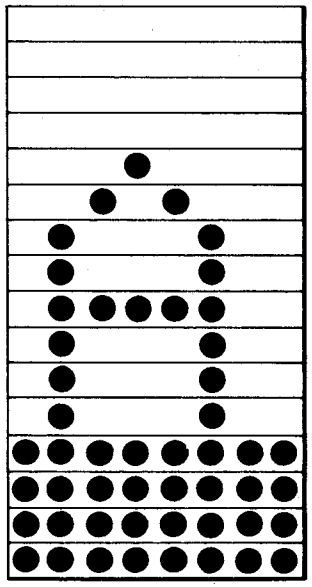
FIGS. 19A to 19D are diagrams showing examples of displays with/the special functions of a letter "A"
Figure 19C:
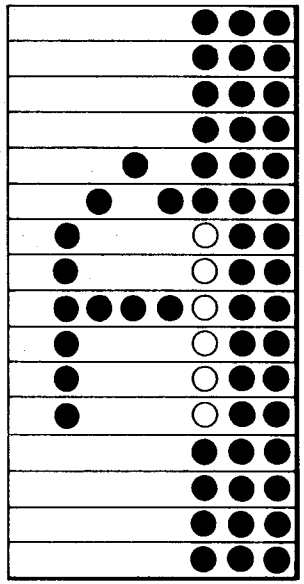
Figure 19B:
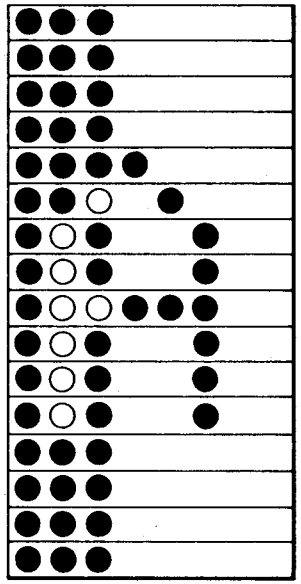
Figure 19A:
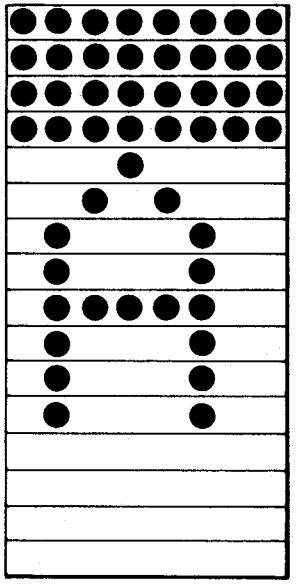

The display in the case of a letter "A" with a special function in the above-mentioned constitution will then be described. FIGS. 19A to 19D show examples of displays with the special function of a letter "A". FIG. 19A shows the superscript. FIG. 19B shows the change of line space. FIG. 19C shows the stop position. FIG. 19D shows the subscript. Namely, by inverting only a portion of the font and displaying a character, it is represented that the character has a special function. Such special display, bold display, underlined display, etc. are called the attribute of the character.

The displaying methods in the case of FIGS. 19A and 19B will then be described.

Figure 20:
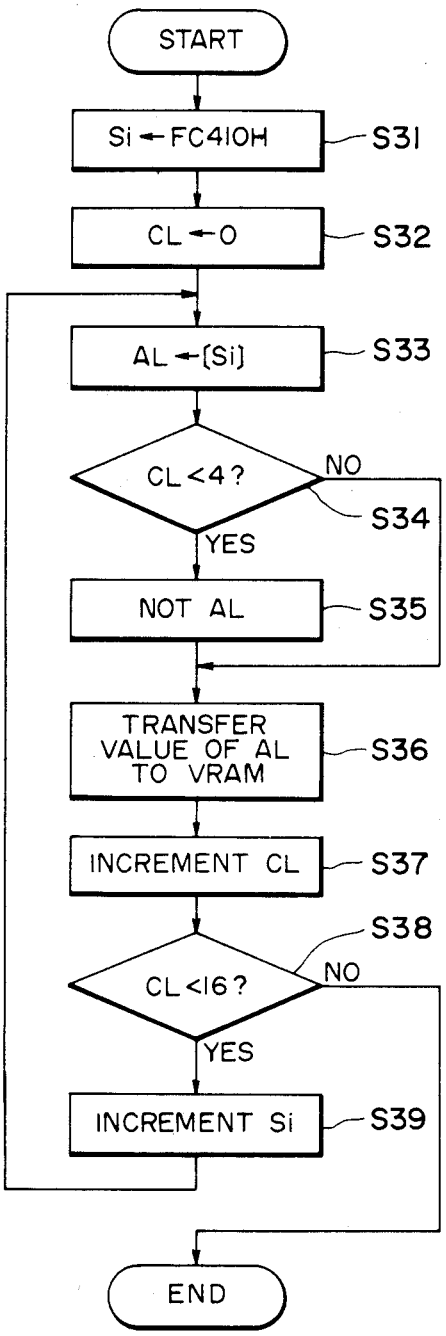
FIG. 20 is a display control flowchart for the superscript.

FIG. 20 is a display control flowchart for the superscript of FIG. 19A. First, since the character code of a letter "A" is "$41_H$", the start address of the font is $$FC000_H + 41_H * 16 = FC410_H,$$

so that ($FC410_H$) is substituted for the address pointer Si in step S31. Then, the content of the register CL (which is used as a line counter in the vertical direction) in FIG. 18 is cleared in step S32. In the next step S33, the content of the address specified by the address pointer Si (in this case, "$000_H$") is substituted for the content of the register AL. Subsequently, a check is made to see if the value of the line counter CL is four or less in step S34. If it is less than four lines in step S34, the data ($000_H$) of the register AL is inverted in step S35 and the value of the AL is transferred to the VRAM 305 in step S36, thereby to display the superscript symbol as shown in FIG. 19A.

In the next step S37, the content of the line counter CL is increased by only "1" for every line. A check is then made to see if the value of the counter CL is 16 or less in step S38, thereby discriminating whether the process of one character has been finished or not. If NO in step S38, namely, when the process of one character is not finished, the address pointer Si is increased by only "1" in step S39, thereby to specify the next data. Then, the processing routine is returned to step S33. On the contrary, if it is YES in step S38, the pattern as shown in FIG. 19A is displayed on the CRT display so that this flowchart is finished.

Figure 21:
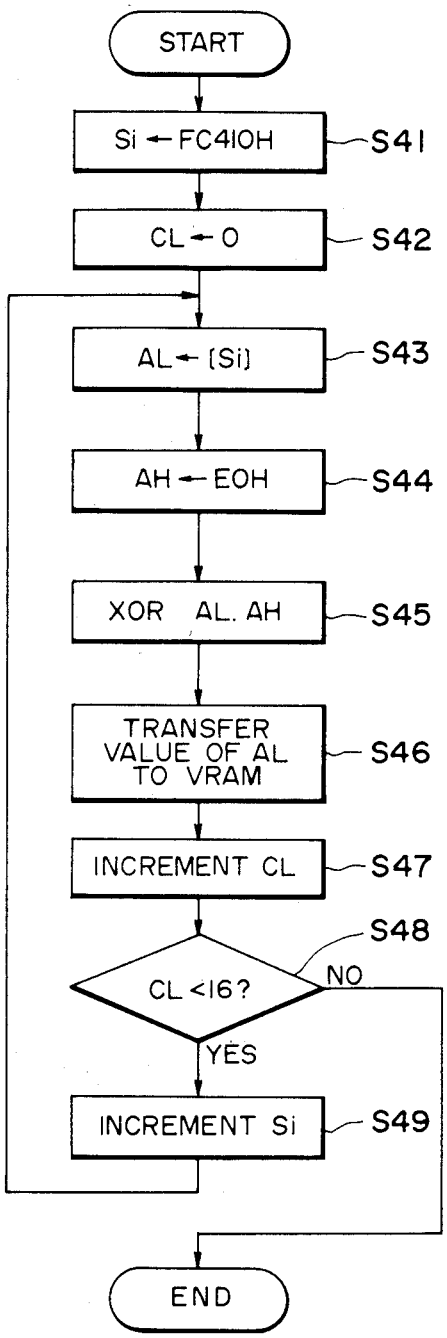
FIG. 21 is a display control flowchart for the line space change function.

The display control flowchart for a character with the line space change function shown in FIG. 19B will then be described with reference to FIG. 21. A different point between FIGS. 19A and 19B is that the symbol indicative of the special function is displayed with respect to four lateral rows in the case of FIG. 19A and with regard to three vertical columns in the case of FIG. 19B. Therefore, the procedures in steps S41 to S43 in FIG. 21 are the same as those in FIG. 20. In Step S44, the initial value $EO_H$ (the binary number "11100000", namely, three bits on the left side are ON) is stored in the register AH. In the next step S45, exclusive OR of the contents of the registers AL and AH is obtained and its value is stored in the register AL. Then, the value of the register AL is transferred to the VRAM in step S46. Steps S47 to S49 are the same as steps S37 to S39 in FIG. 20. The portions of the fifth, sixth and seventh columns excluding the black dots of FIG. 17 are inverted due to the exclusive OR in step S45, so that they become the black dots. On the contrary, the black dots of the fifth to seventh columns of FIG. 17 are inverted and become the white circles. Thus, the display pattern as shown in FIG. 19B can be lastly obtained.

As described in detail in the above, according to the present invention, various characters with a special function can be realized by partially inverting and displaying it. Therefore, there is an effect such that the display which can be easily seen and understood by the operator can be derived which has an inexpensive construction. On one hand, the display patterns are not necessarily limited to the patterns shown in FIGS. 19A to 19D but may be any other patterns. It is also obviously possible to adopt a combination of patterns.

What is claimed is:

1. A display apparatus, comprising:

first memory means for storing a plurality of character patterns;

transforming means for transforming the character patterns stored in said first memory means to bold character patterns;

second memory means for storing bold character patterns corresponding to some selected patterns from among said plurality of character patterns stored in said first memory means;

discriminating means for determining whether or not a bold character pattern to be displayed is stored in said second memory means when a character pattern stored in said first memory means is to be displayed as a bold character pattern; and means for controlling said transforming means to transform the character pattern stored in said first memory means into a bold character pattern in response to said discriminating means determining that the bold character pattern to be displayed is not stored in said second memory means.

2. An apparatus according to claim 1, further having display means for displaying one or more of the character patterns stored in said first memory means and the bold character patterns changed by said transforming means and the bold character patterns stored in said second memory means.

3. An apparatus according to claim 1, wherein codes are added to the character patterns stored in said first memory means and the bold character patterns stored in said second memory means, respectively, and said apparatus further has a conversion table in which the codes of said character patterns and the codes of said bold character patterns correspond to each other.

4. A display apparatus comprising:

first memory means for storing a plurality of character patterns;

second memory means for storing ornamented character patterns corresponding to some patterns selected from among the plurality of character patterns stored in said first memory means;

discriminating means for determining whether or not an ornamented character pattern to be displayed is stored in said second memory means when the corresponding character pattern is stored in said first memory means is to be displayed as an ornamented character pattern; and control means for displaying a modification of the character patterns stored in said first memory means as the ornamented character pattern to be displayed in response to a determination by said discriminating means that the ornamented character pattern to be displayed is not stored in said second memory means.

5. A display apparatus according to claim 4 further comprising input means for inputting character data to be displayed and data representing whether the character data should be ornamented.

6. A display apparatus according to claim 4 further comprising read-out means for reading out character pattern from said second memory means when said discrimination means determines that the ornamented character pattern to be displayed is stored in said second memory means.

7. A display apparatus according to claim 6 further comprising display means for displaying the character patterns ornamented by said character pattern ornamenting means or the character pattern read out by said read-out means.

8. A display apparatus comprising:

first memory means for storing a plurality of ordinary character patterns;

second memory means for storing ornamented character patterns corresponding to the ordinary character patterns stored in said first memory means;

input means for inputting character data designating a character pattern stored in said first memory means, and data indicative of the ornamentation of the character pattern corresponding to the input character data;

discriminating means for determining whether or not an ornamented character pattern is stored in said second memory means for the character pattern corresponding to the character data designated by said input means, when the data indicative of ornamentation is input by said input means; and control means for ornamenting the ordinary character pattern stored in said first memory means in response to said discriminating means determining that the corresponding ornamented character pattern is not stored in said second memory means.

9. A display apparatus according to claim 8 further comprising display means for displaying the character pattern read out by said character pattern read-out means.

10. A display apparatus according to claim 8, wherein said first memory means and said second memory means are arranged in a single memory device.

* * * * *

UNITED STATES PATENT AND TRADEMARK OFFICE

CERTIFICATE OF CORRECTION

PATENT NO. : 4,827,254

DATED : May 2, 1989

INVENTOR(S) : Masaki Nishiyama

It is certified that error appears in the above-identified patent and that said Letters Patent is hereby corrected as shown below:

COLUMN 3:

Line 38, "CPU 101" should read --CPU 101.--.

Line 68, "reference character FFH" should read --reference character $FF_H$--.

COLUMN 6:

Line 7, delete "further".

COLUMN 7:

Line 67, "got," should read --obtained,--.

Signed and Sealed this

Eighteenth Day of September, 1990

*Attest:*

HARRY F. MANBECK, JR.

*Attesting Officer*

*Commissioner of Patents and Trademarks*